US011547199B2

(12) United States Patent
Croteau

(10) Patent No.: US 11,547,199 B2
(45) Date of Patent: Jan. 10, 2023

(54) DUAL POINT QUICK RELEASE SHOULDER STRAP DEVICE

(71) Applicant: Leo Croteau, Three Forks, MT (US)

(72) Inventor: Leo Croteau, Three Forks, MT (US)

( * ) Notice: Subject to any disclaimer, the term of this patent is extended or adjusted under 35 U.S.C. 154(b) by 134 days.

(21) Appl. No.: 17/096,860

(22) Filed: Nov. 12, 2020

(65) Prior Publication Data

US 2021/0186185 A1 Jun. 24, 2021

Related U.S. Application Data

(60) Provisional application No. 62/934,982, filed on Dec. 22, 2019.

(51) Int. Cl.
*A45F 3/04* (2006.01)

(52) U.S. Cl.
CPC ..... *A45F 3/047* (2013.01)

(58) Field of Classification Search
CPC .... A45F 3/047; A45F 3/14; A45F 3/04; A45F 3/06; A45F 3/02; A45C 13/30; A41D 13/0568; A44B 11/266; F41H 1/02
USPC ..... 224/631, 642–643
See application file for complete search history.

(56) References Cited

U.S. PATENT DOCUMENTS 5,961,014 A * 10/1999 Knerr ..... A45F 3/04 224/259

FOREIGN PATENT DOCUMENTS

DE 102015106868 A1 * 11/2016 ..... F41H 1/02
WO WO-2004084672 A1 * 10/2004 ..... A45F 3/14

* cited by examiner

*Primary Examiner* — Nathan J Newhouse
*Assistant Examiner* — Matthew T. Theis
(74) *Attorney, Agent, or Firm* — Loza & Loza, LLP; Gordon R. Lindeen, III

(57) ABSTRACT

In some embodiments, a strap assembly has a chest compression strap having a loop at one end, a connection fitting having an anchoring strip at one end proximate a connection fitting connector and configured to attach to a pack at another end opposite the anchoring strip, and a shoulder strap having a channel proximate a shoulder strap connector and configured to retain the anchoring strip when the connection fitting connector is attached to the shoulder strap connector, the shoulder strap being configured to attach to a pack at another end opposite the shoulder strap connector, the shoulder strap having a guideway through the channel configured to receive the chest compression strap loop, wherein the anchoring strip engages the loop when the anchoring strip is retained in the channel.

20 Claims, 7 Drawing Sheets

DUAL POINT QUICK RELEASE SHOULDER STRAP DEVICE

CROSS-REFERENCE TO RELATED APPLICATIONS

This application claims the priority of U.S. Provisional Application Ser. No. 62/934,982, filed Dec. 22, 2019, entitled Dual Point Quick Release Shoulder Straps which is hereby incorporated herein by reference.

FIELD

The present description relates to the field of shoulder carried loads and, in particular to harness releases for such loads.

BACKGROUND

Shoulder-carried loads such as backpacks rucksacks, and the like typically use a shoulder strap over each shoulder that attach to the bottom of the pack near the hips or waist. A chest compression strap connects the two shoulder straps across the chest and better stabilizes a heavy or bulky shoulder-carried load. Such packs are common and used widely in the civilian, military, and first responder's day to day activities. Chest compression straps are well known and come in a wide range of styles and designs. All three straps, the chest and shoulder straps are secured with a connection fitting or buckle that is quickly attached and released. To put on and take off such a shoulder-carried load, the chest compression strap and at least one of the shoulder straps is disconnected.

BRIEF DESCRIPTION OF THE DRAWING FIGURES

The invention may best be understood by referring to the following description and accompanying drawings that are used to illustrate embodiments of the invention.

Figure 5:
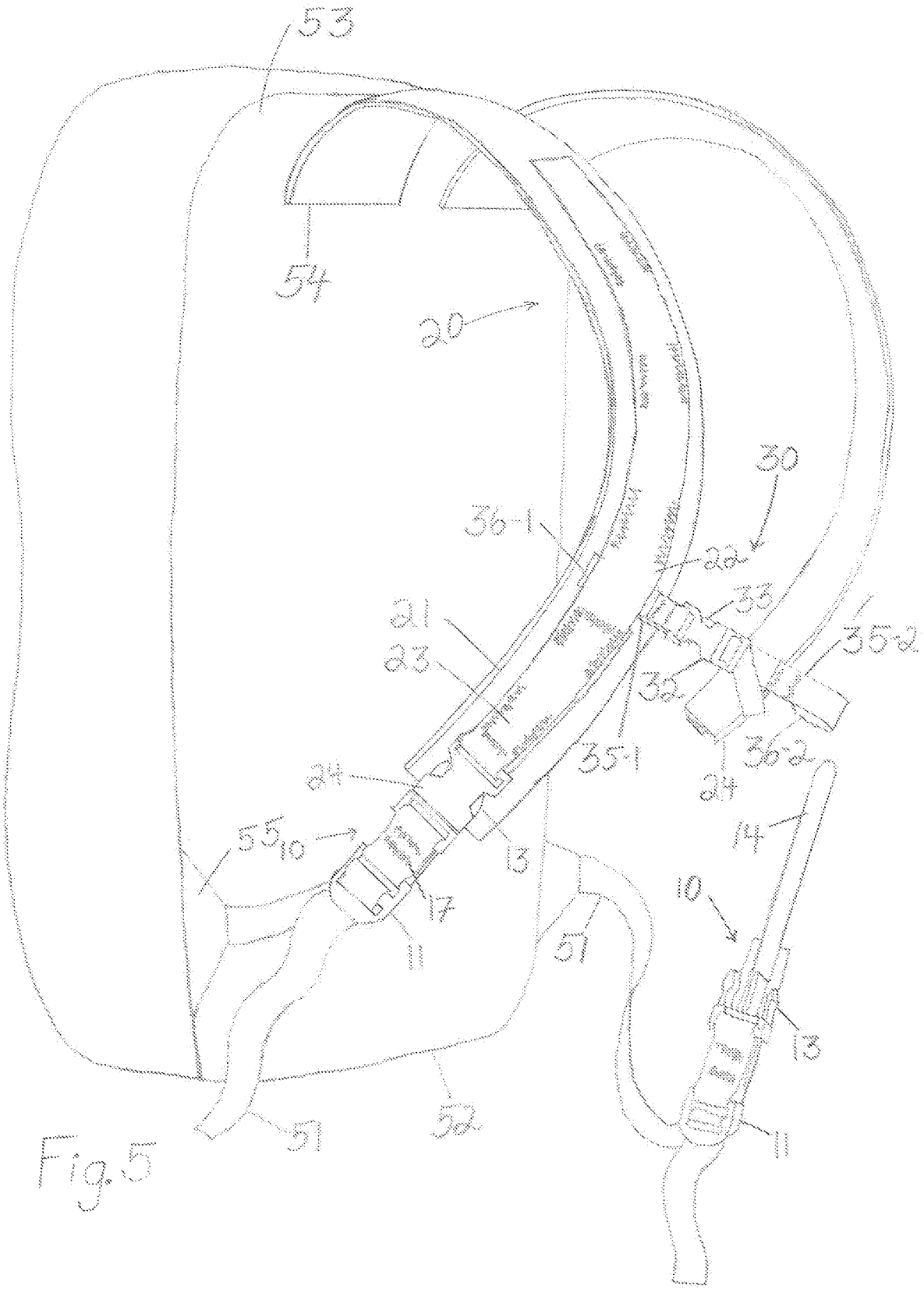

FIG. 5 a perspective view of a backpack with a dual point quick release shoulder strap assembly according to embodiments of the invention.

Figure 6:
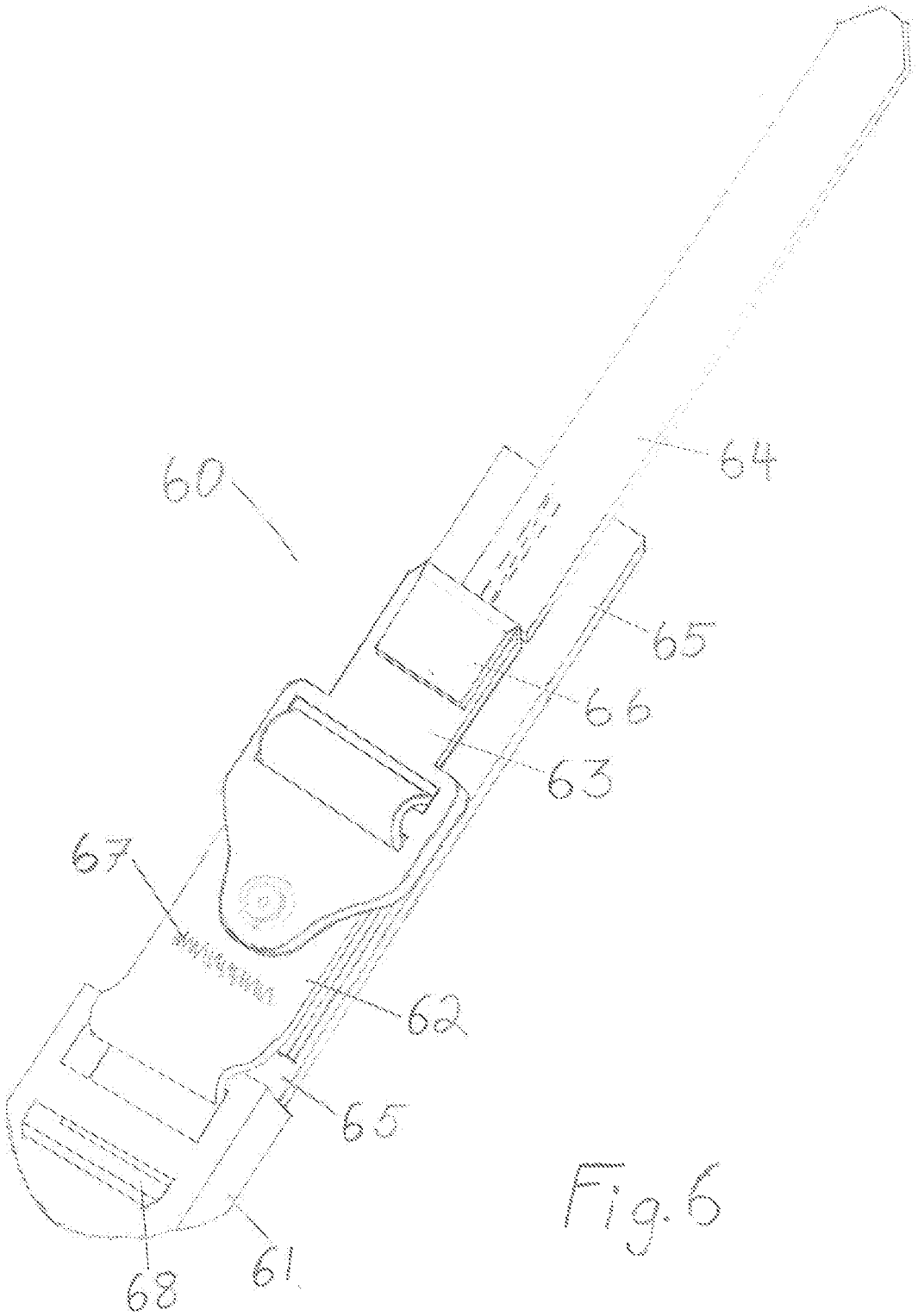

FIG. 6 is a perspective view of an alternative quick release assembly according to embodiments of the invention.

Figure 7:
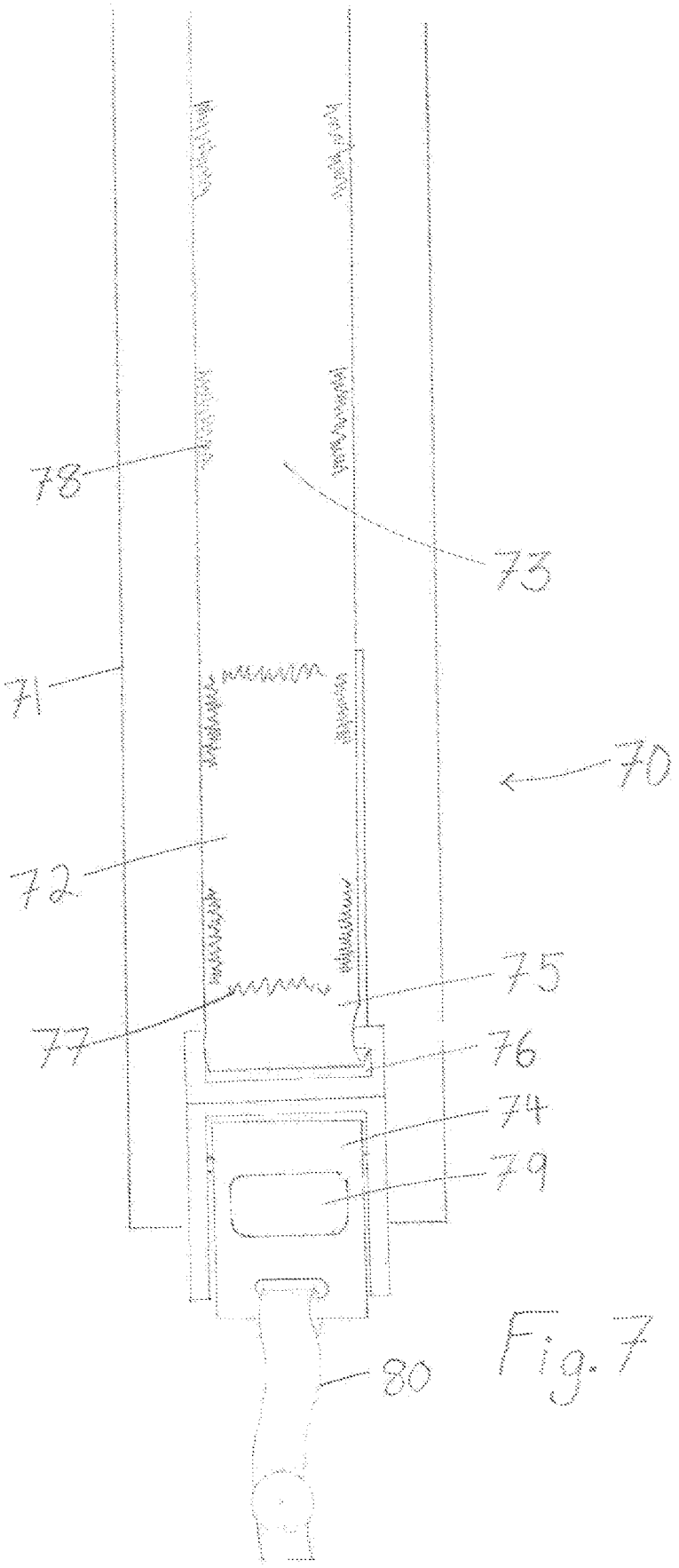

FIG. 7 is a front plan view of an alternative shoulder strap channel assembly according to embodiments of the invention.

DETAILED DESCRIPTION

The present description relates to loads that are carried with two shoulder straps and a chest compression strap between them. Such a load may be carried on the shoulders or the hips or both and have a variety of different names that refer to similar or identical articles. For ease of reference, such a load is referred to herein as a backpack, but the term "backpack" applies to any of a variety of different shoulder strap loads including backpacks, rucksacks, ruckpacks, knapsacks, daypacks, packs, and other similar loads.

For further ease of reference, the "backpack" is referred to herein as having a "pack" which holds the load and straps which attach to the pack. The "pack" as used herein may include an internal or external soft or rigid frame, various additional straps, and fabric or solid containers. A simple pack may simply be a rectangular nylon bag. A complex pack may have an aluminum or composite frame with rigid compartments and attached equipment. Any accessories, attached to the pack may be considered to be a part of the pack for purposes of the present description. The load may be books, provisions, communications equipment, a parachute, or anything else carried with shoulder straps and a chest compression strap. The present invention does not depend on the nature of the pack or the nature of the load that the pack comprises or holds.

The dual point quick release shoulder strap device described herein enables the virtually simultaneous and quick release of a chest compression strap as the first point and a shoulder strap as the second point of a backpack from a single quick release. This quick release is located on the distal end of one or both of the shoulder straps, opposite the load. The simultaneous release may be performed while a user is carrying or wearing the backpack over the shoulders.

In one embodiment, a dual point quick release shoulder strap includes one or more shoulder straps, one or more chest compression straps, and one or more quick release assemblies that are secured to the shoulder straps by a connection fitting located at the distal end of a shoulder strap channel. A quick release assembly includes a connection fitting, an adjustment fitting and an anchoring strip that are connected by a folded length of webbing and secured together by stitching or the like. The adjustment fitting on the distal end of the quick release assembly has a length of webbing threaded through it that connects the shoulder-mounted load. The connection fitting at the proximal end of the quick release assembly connects to the connection fitting at the distal end of the shoulder strap channel. When the wearer releases the connection fitting at the distal end of the shoulder strap channel, the quick release assembly moves down and away, pulling the anchoring strip out of the channel and releasing the chest compression strap from the guideway in one smooth motion. This allows the backpack to be quickly and efficiently disengaged from the wearer.

To remove a backpack with no chest compression strap, the wearer easily and quickly slides the two shoulder straps outwards to the side and pulls the shoulders away from the straps. When the straps are tight, then one of the shoulder straps is released first. With a chest compression strap, the wearer must first release at least the chest compression strap before being able to remove the pack. The chest compression strap greatly increases comfort in carrying the pack but there is the added step created by yet another connection fitting that must be separated before the wearer can remove the shoulder mounted backpack. This adds to the time required to remove the backpack and access contents of the pack. In some cases, such as for first responders and war fighters, that extra time may be significant. In some cases, lives may depend on the ability to quickly disengage a heavy or bulky load when faced with urgent circumstances, such as responding to enemy contact, accessing emergency equipment, or escaping a burning building through a small opening.

As described herein, the wearer's ability to quickly and efficiently remove even a heavy backpack from his or her back is improved using a simple quick release assembly that simultaneously releases both the lower shoulder strap web and the chest compression strap on the shoulder strap with a single action. This significantly improves a first responder's and war fighter's ability to more effectively react to hostile environments while providing more support when carrying heavy loads without the added steps of disconnecting both the lower shoulder strap connector and the chest compression strap individually. It works equally well on the left, right, or both shoulder straps so the backpack can be removed regardless of the wearer's preference, disability, or injury during an emergency.

The described dual point quick release shoulder strap device enables the simultaneous release of a chest compression strap(s) and shoulder strap from a single release point that may be located on the distal end of one or more of the shoulder straps. The release may be made while a user is carrying a shoulder mounted load. In embodiments, the dual point quick release shoulder strap includes one or more shoulder straps, one or more chest compression straps, and one or more quick release assemblies that are secured to the shoulder straps by a connection fitting located at the distal end of the shoulder strap channel.

Such a dual point quick release shoulder strap is easy to build and can use a wide variety of industry standard connectors, fasteners, webbings, fabrics, plastics, natural fibers, and foams to suit the specific needs of the end user. Because of its simple and rugged design, it doesn't rely on specialty parts with limited quantities, or demand a highly skilled laborer to produce. A higher quality end product is produced at lower cost. This allows for a smoother more streamlined production resulting in a better finished product for the end user.

Figure 1:
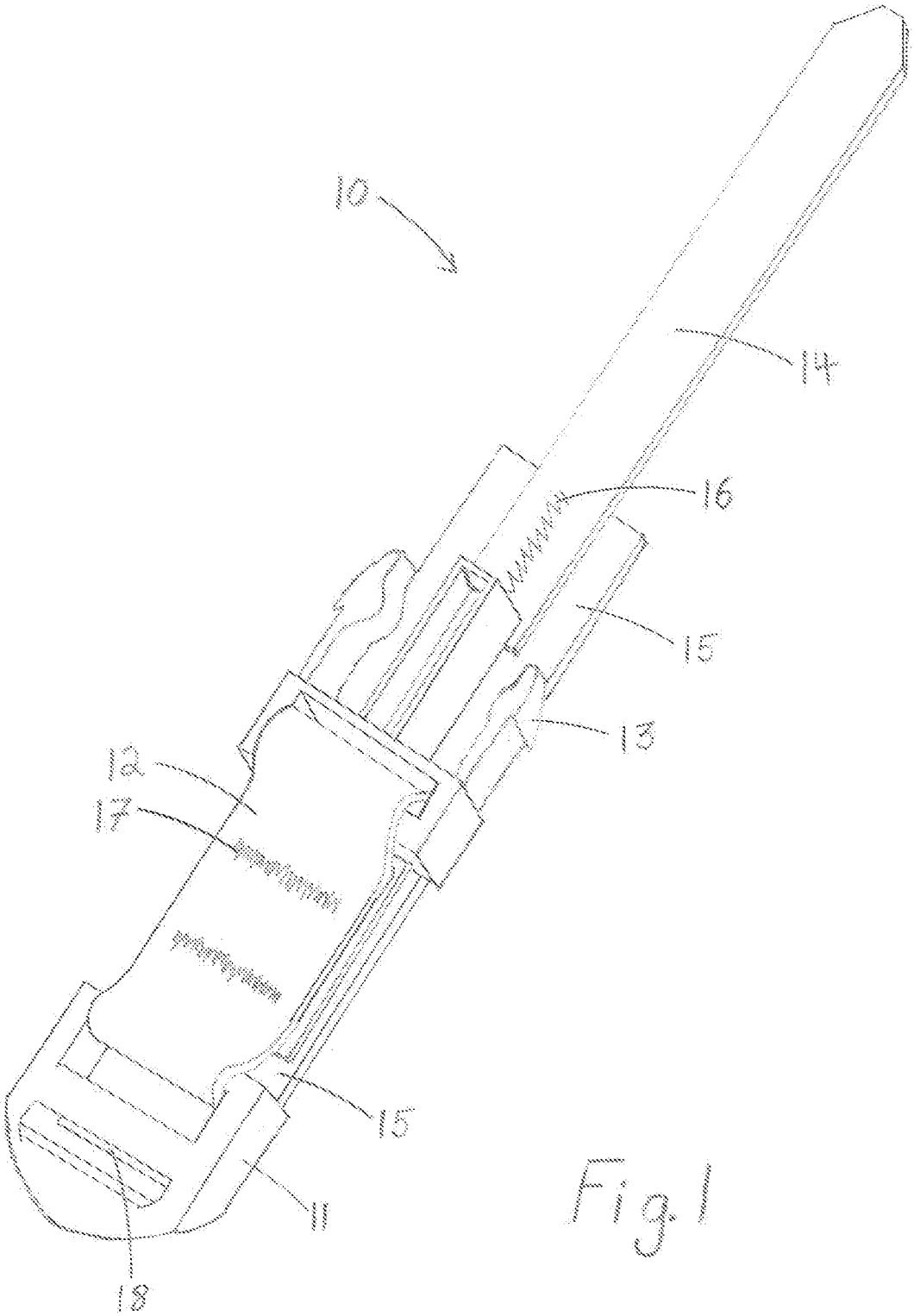
FIG. 1 is a perspective view of a quick release assembly according to embodiments of the invention.

FIG. 1 is a perspective view of a quick release assembly 10. The quick release assembly 10 includes a connection fitting 13, an adjustment fitting 11, and an anchoring strip 14. The connection fitting 13 and adjustment fitting 11 are connected to each other by a folded length of webbing 12 or other material. A base plate 15 extends from the adjustment fitting 11, under the connection fitting 13 to the anchoring strip 14. The anchoring strip 14 and webbing 12 are secured to the base plate by stitching 16, 17, bar tacks, snaps, grommets, glue, or another suitable fastening technique. The adjustment fitting 11 and connection fitting 13 may also be secured to the base plate by stitching, bar tacks, snaps, grommets, glue, or another suitable fastening technique. The anchoring strip 14 is made from a semirigid material (such as plastics, e.g. polyethylene, metals, fiberglass, or the like). The specific size and thickness of the anchoring strip 14 may vary depending on the size and type of the fittings, webbing, and overall shoulder strap size which will be determined by industry standards and the wearer's preference. The anchoring strip 14 may be configured to move with moderate to little resistance in the shoulder strap channel 23 shown in FIG. 2. The base plate 15 may also be made of any of the semirigid materials above or it may be made of the same or a similar material as the webbing 12.

The webbing 12 may be made from plastics, natural fibers, rubbers, metals, or the like. While this material is referred to herein as webbing, it need not be woven or webbed but may be a chained, mesh, solid, extruded, molded or cast material of different constructions. In some implementations, the webbing 12 and many of the other components described herein may be made using standardized or specified parts to meet user requirements. Some users may issue specifications for backpacks and other equipment for strength, durability, and safety. Embodiments described herein may be constructed using parts that are already certified as meeting these specifications. In some implementations, the fittings and webbing being described throughout are no more than 3 inches wide and no narrower than 0.1 inches in width and the webbing described may be formed of rope, fabrics, or tubing, and may be flat, rounded, oval or the like in cross-section. The adjustment fitting 11 on the distal end of the quick release assembly has a connector 18, in this case in the form of a slot to receive a length of webbing 51, as shown in FIG. 5. The connector 18 allows the quick release assembly 10 to be attached to an end of the backpack 50 and it allows the length of the length of webbing 51 to be adjusted to suit different users.

Figure 2:
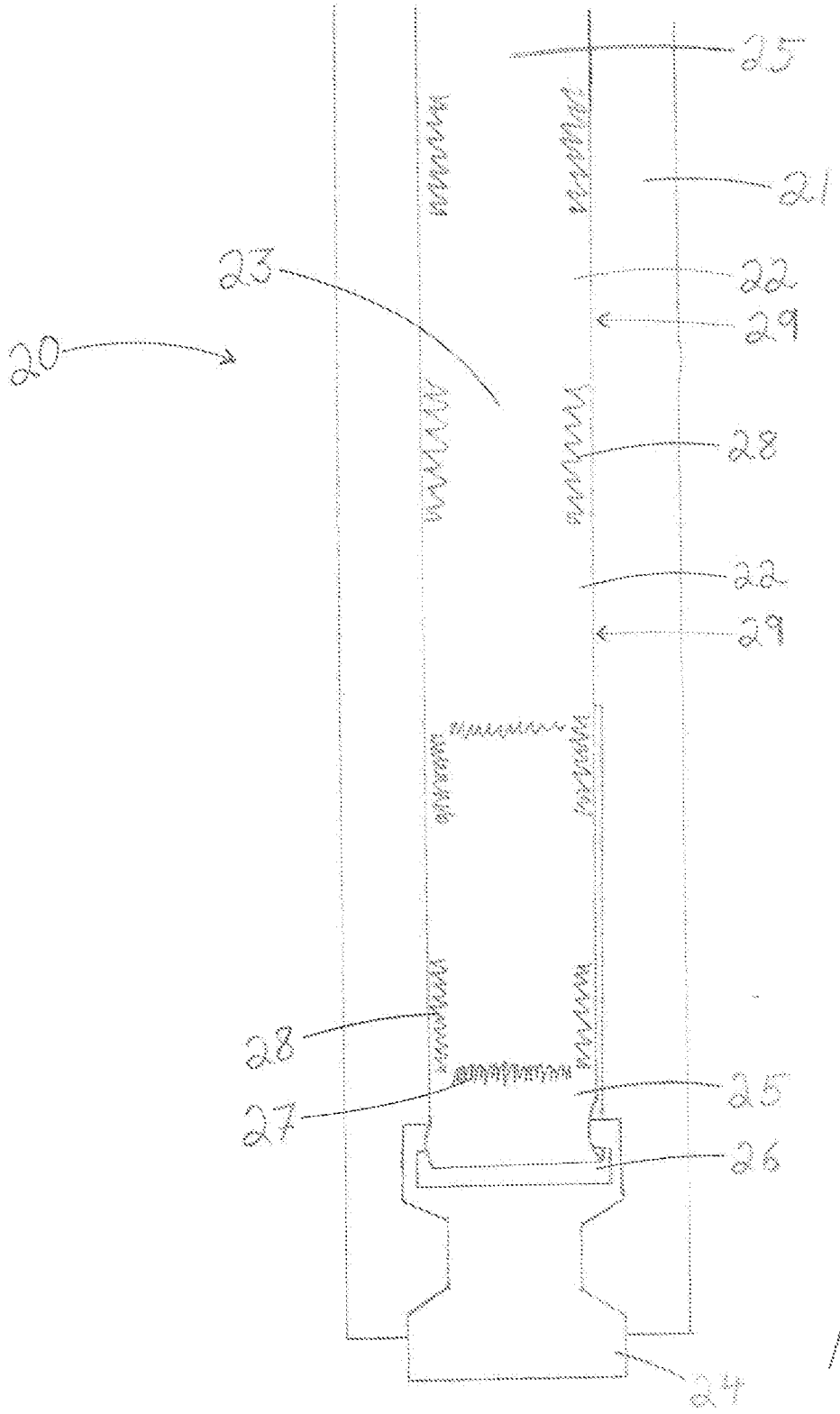
FIG. 2 is a front plan view of a shoulder strap channel assembly according to embodiments of the invention.

FIG. 2 is a front plan view of a shoulder strap channel assembly 20. The shoulder strap channel assembly 20 includes a shoulder strap 21, a connection fitting 24, and a channel 23 with one or more guideways 22 positioned across the channel 23 of the chest compression strap assembly 30 shown in FIG. 3 to be inserted into and secured by the anchoring strip 14. The proximal end of the shoulder strap channel assembly 20 is worn over the shoulder of the wearer and secured to the shoulder mounted load (backpack or like article) 50. The proximal end 54 of the shoulder strap assembly 20 is proximal with respect to the load or pack 52. The shoulder strap 21 may be constructed using plastic, webbing, fabric, foam, or other like materials. The connection fitting 24, may be made from plastics, metals, fiberglass, or the like.

The webbing 25 is threaded through a slot 26 in the connection fitting 24, folded over onto itself and secured by stitching 27, bar tacks, snaps, grommets, glue, or similar fastening techniques. The sides of the webbing 25 are secured to the shoulder strap 21 by further stitching 28 to create the channel 23 and guideways 22 that are positioned across the channel 23. The channel extends along the strap and the stitching forms sides of the channel. The anchoring strip is inserted transversely into the channel and the sides of the channel restrict any lateral movement of the anchoring strip with respect to the shoulder strap within the channel. The webbing 23 may be stitched 27 to the connection fitting 24 before the channel 23 and guideways 22 are stitched 28. The specific size of the fittings may vary depending on the end user's preference and other concerns. Generally, the fittings may be from plastics, metals, or the like and may vary in design and function.

The channel 23 and guideways 22 are created by securing the sides of the webbing 25 to the shoulder strap 21 while leaving gaps in the stitches to provide openings 29 between the webbing 25 and the shoulder strap 21 large enough to accommodate the chest compression strap assembly 30. The channel 23 is formed in this way by stitching the second length of webbing 25 along its sides to the shoulder strap 21 which, in this context, is a first length of webbing. The stitching is transverse with respect to the shoulder strap. This attaches the length of webbing to the shoulder strap. The connection fitting 24 connects with the mating connection fitting 13 of FIG. 1 to attach the quick release assembly 10 to the shoulder strap channel assembly 20. In so doing the anchoring strip 14 slides transversely under the connection fitting 24 and into the channel 23 between the webbing 25 and the shoulder strap 21. It is prevented from significant lateral movement by the transverse stitches 27 between the webbing and the shoulder strap 21 that form the channel 23.

Figure 3:
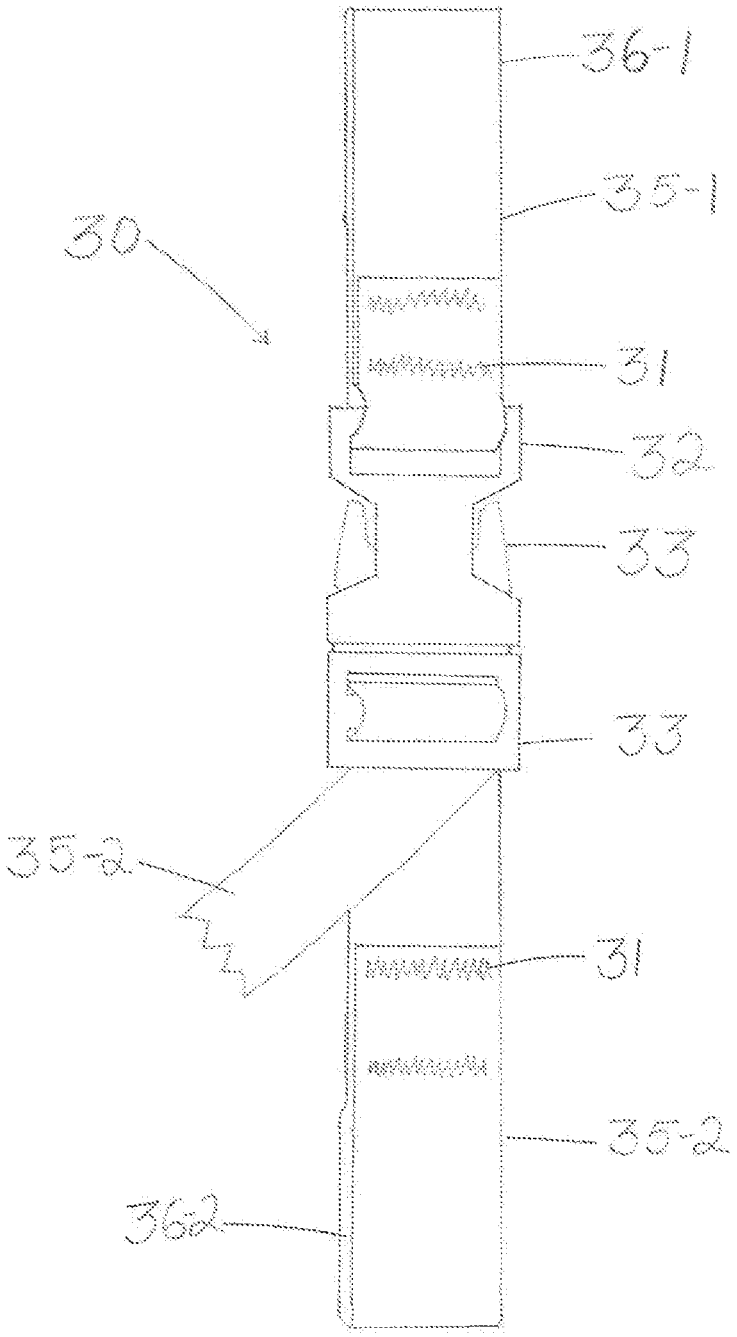
FIG. 3 is a front plan view of a chest compression strap assembly according to embodiments of the invention.

FIG. 3 is a front plan view of a chest compression strap assembly 30. The chest compression strap assembly 30 includes a connection fitting, both male 33 and female 32 parts that lock together as shown, with or without an integrated adjustment feature. On each end of the chest compression strap assembly, a strap 35-1, 35-2 is folded in such a way that a securement loop 36-1, 36-2 is created on the distal end of each strap 35-1, 35-2. The distal ends are at each end of the chest compression strap distal with respect to the central connection fitting 32, 33. The respective connection fitting 32, 33 is secured on the central end and the webbing of the strap 35-1, 35-2 is fastened in place with stitching 31 or the like. The lower strap 35-2 as shown, is threaded through a connection fitting 33, in this case the male connection fitting, although the other fitting may be used, with an integrated adjustment feature. This integrated adjustment feature may be used to adjust the length of the chest compression strap assembly 30 to suit different users. The components of the chest compression strap assembly may be made from the same materials as discussed above.

In use, each loop 36-1, 36-2 is passed through a respective one of the guideways 22 of a shoulder strap channel assembly 20 on opposite sides of the backpack between the webbing 25 and the shoulder strap 21. The anchoring strips 14 of each quick release assembly 10 are then passed into the channel 23 of the shoulder strap channel assembly 20 and through the respective loop 36-1, 36-2. In this way the anchoring strips 14 secure the chest compression strap assembly to each shoulder strap channel assembly. The connection fitting 13, 24 secures the anchoring strip 14 to the shoulder strap channel assembly 20.

Figure 4:
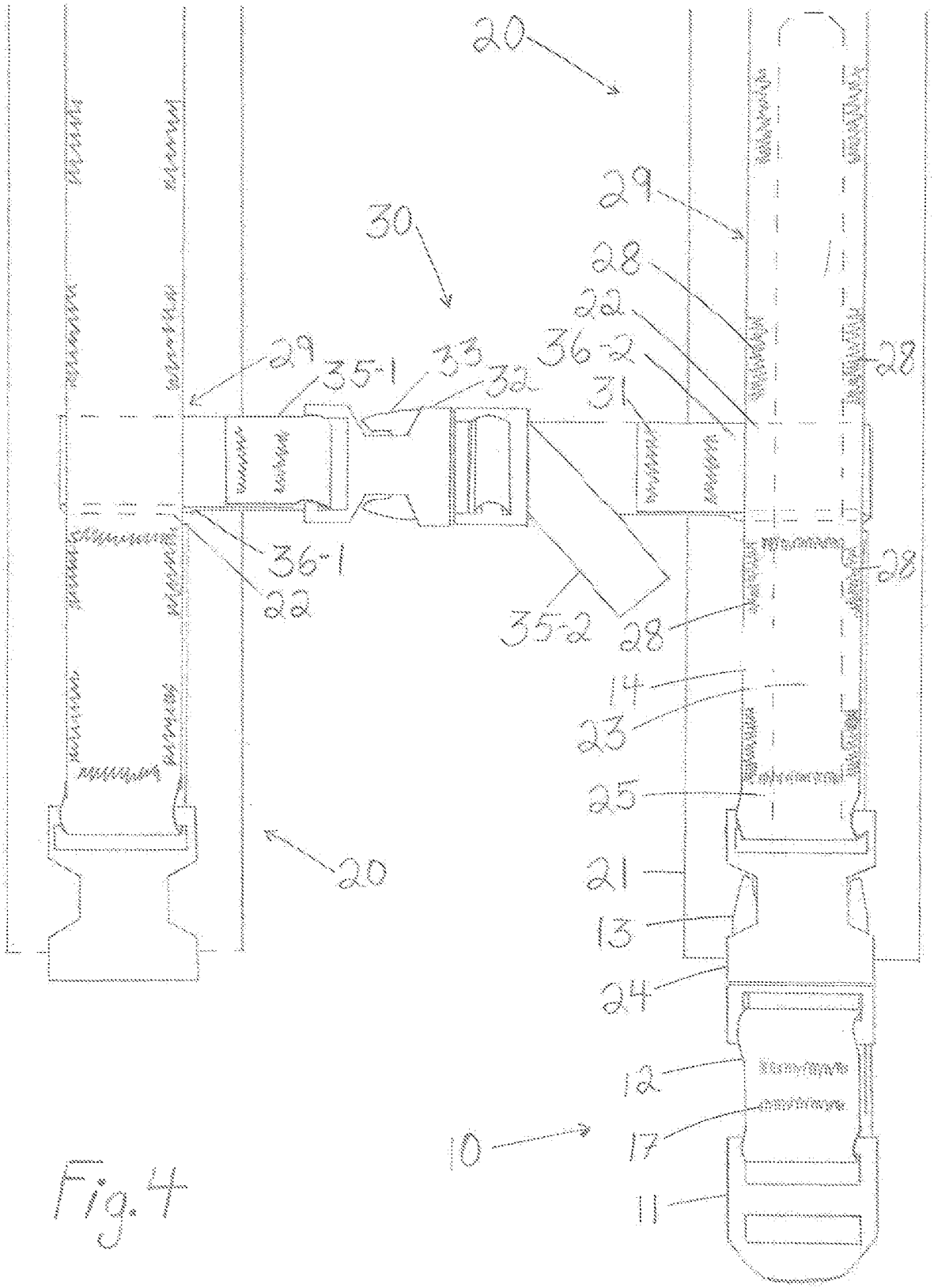
FIG. 4 is a front plan view showing a partial assembly of a dual point quick release shoulder strap assembly according to embodiments of the invention.

FIG. 4 is a front plan view showing a partial assembly of the quick release assembly, shoulder strap channel assembly, and chest compression strap assembly with a chest compression strap assembly loop inserted into a shoulder strap channel assembly guideway and secured by a quick release assembly anchoring strip. The loops 36-1, 36-2 of the chest compression strap assembly 30 are inserted into the corresponding guideways 22 of each shoulder strap channel assembly 20 on each side of the chest compression strap assembly 30. The right side loop 36-2, as shown, is secured on one side by the anchoring strip 14 of the quick release assembly 10. The anchoring strip 14 of the quick release assembly 10 is inserted through the channel 23 of the shoulder strap assembly and secured in place by the connection fittings 13, 24.

The shoulder strap channel is proximate the connector formed by the connection fittings 13, 24. The channel is configured to retain the anchoring strip in the channel when the connection fitting connector is attached to the shoulder strap connector. As shown in FIG. 5, the shoulder strap is configured to attach to a pack at another end opposite the shoulder strap connector. The chest compression strap loop is inserted into the guideway of the channel which receives the loop and the anchoring strip extends through the loop in the channel when the anchoring strip is retained in the channel.

The left-side loop 36-1 of the chest compression strap assembly 30 is inserted into the guideway 22 of the second or left side shoulder strap channel assembly 20 but the anchoring strip 14 of the left side quick release assembly (not shown) is not yet snapped into place to secure the loop 36-1. The left-side loop 36-1 may easily be removed from the guideway by a light pull to the right on any part of the chest compression strap 30 as shown in the drawing. Similarly, it may be understood that releasing the quick release attachment 10 by pushing on the tabs of the connection fitting 13 allows the anchoring strip 14 to slide out of the channel 23 of the shoulder strap channel assembly 20. This releases the loop 36-2 of the chest compression strap 30 without releasing the connection fittings 32, 33 of the chest compression strap assembly 30.

FIG. 5 is a perspective view of a backpack with a quick release shoulder strap device. The backpack 50 includes a pack 52, quick release assemblies 10 attached near the bottom of the pack 52, shoulder strap channel assemblies 20 attached near the top of the pack 52 and a chest compression strap assembly 30 between the two shoulder strap channel assemblies. The proximal end 54 of the shoulder strap channel assembly 20 is secured to the proximal portion 53 of the pack. The distal end of the distal webbing 51 is threaded through the adjustment fitting 11 and attaches generally to the sides of the distal portions 55 of the pack.

The described dual point quick release shoulder strap device may be integrated into a shoulder mounted load (such as a backpack, rifle bag, or harnessing) during the manufacturing of the product, or may be manufactured and sold as an after-market accessory or replacement for existing products that utilize one or more shoulder straps. In another embodiment it may be used on a product where only a single shoulder strap is needed like a courier bag, rifle bag, or like article and may utilize more than one chest compression strap assembly. When used as a single shoulder strap; one end of the chest compression strap assembly is secured by some means to the shoulder mounted load and the other end may be folded and secured to a connection fitting. A second strap is folded in such a way as to create a securement loop on one end of the strap and the other side is threaded through a connection fitting with an integrated adjustment feature. The securement loop is inserted into the guideways of the shoulder strap channel assembly and secured by the anchoring strip.

As shown in FIG. 5 the quick release assembly 10 includes a connection fitting 13, an adjustment fitting 11, and an anchoring strip 14 that are connected by a folded length of webbing and secured together by stitching 17 or the like. The adjustment fitting on the distal end of the quick release assembly has a length of webbing 51 threaded through it that connects to the distal portion 55 of the shoulder mounted load 52 such as a pack or like article.

The shoulder strap channel assembly 20 includes a shoulder strap 21, a connection fitting 24, and a channel 23 with one or more guideways 22 for one or more chest compression strap assemblies 30 to be inserted and secured by the anchoring strip 14. The proximal end 54 of the shoulder strap assembly is worn over the shoulder of the wearer and secured to the shoulder mounted load 52. The proximal end is proximal with respect to the load 52 so that the proximal end of the shoulder strap assembly is attached to the proximal portion 53 of the load 52.

The chest compression strap assembly 30 includes a connection fitting with male 33 and female 32 parts configured to lock together as shown. The male part also has an integrated adjustment feature and another may be provided on the female part. A strap 35-1, 35-2 is folded in such a way that a securement loop 36-1, 36-2 is created on one end and a connection fitting is secured on the other end and the webbing is secured together by stitching 31 or the like.

The adjustment fitting 11 on the distal end of the quick release assembly 10 has a length of webbing 51 threaded through it that connects to the pack 52. The connection fitting 13 at the proximal end of the quick release assembly 10 connects to the connection fitting 24 at the distal end of the shoulder strap channel 23. The proximal end of the quick release assembly is proximal with respect to the distal end of the shoulder strap channel. The distal end of the shoulder strap channel is distal with respect to the chest compression strap and guideway. When the wearer releases the connection fitting 13, 24 at the distal end of the shoulder strap channel on either the left strap, right strap or both, the quick release assembly 10 moves down and away, pulling the anchoring strip 14 out of the channel 23 and releasing the chest compression straps 35-1, 35-2 from the guideways 22 in one smooth motion. This allows the shoulder mounted load 52 to quickly and efficiently disengage from the wearer.

FIG. 6 is a perspective view of an alternative quick release assembly 60 using a different type of connection fitting. The quick release assembly 60 includes a connection fitting 63, an adjustment fitting 61, and an anchoring strip 64. The connection fitting 63 and adjustment fitting 61 are connected to each other by a folded length of webbing 62. A base plate 65 extends from the adjustment fitting 61, under the connection fitting 63 to the anchoring strip 64. The anchoring strip 64 and webbing 62 are secured to the base plate by stitching 67 or in any other suitable way. The connection fitting 63 features an interlocking tab 66 attached to a rigid back plate of the connection fitting 63. The anchoring strip slides into a channel to hold a chest compression strap as explained above.

FIG. 7 is a front plan view of an alternative shoulder strap channel assembly 70 configured to connect with the quick release assembly 60 of FIG. 6. The shoulder strap channel assembly 70 includes a shoulder strap 71, a connection fitting 74, and a channel 73 with one or more guideways 72 for the chest compression strap assembly 30 shown in FIG. 3 to be inserted and secured by the anchoring strip 64. The webbing 75 is threaded through a slot 76 in the connection fitting 74, folded over onto itself and secured by stitching 77, for example. The sides of the webbing 75 are secured to the shoulder strap 71 by further stitching 78 to create the channel 73 and guideways 72. The connection fitting 74 features a slot 79 to receive the tab 69 of the quick release fitting to attach the two parts together. A release strap 80 is attached at one end of the connection fitting 74. Upon pulling the release strap 80, the connection fitting 74 is released so that the anchoring strip 64 may slide out of the channel 73 and the attached chest compression strap loop 36-1 is freed from the shoulder strap release assembly.

As described above, embodiments may be understood in different variations. In some embodiments, a strap assembly has at least one shoulder strap having a channel and a connection fitting located at a distal end of the channel, at least one chest compression straps, and at least one quick release assembly that is secured to the shoulder strap by the connection fitting of the shoulder strap. The quick release assembly has a connection fitting, an adjustment fitting and an anchoring strip. The connection fitting, the adjustment fitting and the anchoring strip are connected by a folded length of webbing and secured together. The adjustment fitting on the distal end of the quick release assembly has a length of webbing threaded through it that connects to a shoulder-mounted load. The connection fitting at the proximal end of the quick release assembly connects to the shoulder strap connection fitting so that the anchoring strip extends through the channel and engages the chest compression strap. When the wearer releases the connection fitting at the distal end of the shoulder strap channel, the quick release assembly moves down and away, pulling the anchoring strip out of the channel and releasing the chest compression strap from the guideway.

The anchoring strip and the folded length of webbing may be secured together by stitching. The chest compression strap may have a loop at one end that is inserted transversely into the channel to engage the anchoring strip. The channel may have a second length of webbing stitched along its sides to the shoulder strap. The stitching may include gaps along the second length of webbing configured for the loop to be inserted into the channel.

In some embodiments, a strap assembly has a chest compression strap assembly, a connection fitting having an anchoring strip, and a shoulder strap having a guideway configured to receive the chest compression strap assembly inserted therein and a channel to receive the anchoring strip inserted therein to secure the chest compression strap assembly in the guideway. A proximal end of the shoulder strap is configured to be worn over a shoulder of a wearer and secured to a shoulder mounted load.

The chest compression strap assembly may include a second connection fitting with an integrated adjustment feature and a strap secured to the second connection fitting on one end and folded in a configuration of a securement loop on an opposite end, the securement loop being configured to engage the anchoring strip in the guideway. The loop of the folded strip may be fastened by stitching. The guideway may be positioned across the channel.

The connection fitting may have a male and a female connector configured to lock together. The connection fitting may also have a quick release assembly on a distal end of the connection fitting that has a length of webbing threaded through the connection fitting that connects to a pack, the connection fitting further connecting to the shoulder strap channel opposite the distal end. In some embodiments, when the connection fitting at the distal end of the shoulder strap channel is released, then the quick release assembly moves down and away, pulling the anchoring strip out of the channel and releasing the chest compression strap from the guideway disengaging a shoulder mounted load from a wearer.

In some embodiments, a strap assembly has a chest compression strap having a loop at one end, a connection fitting having an anchoring strip at one end proximate a connection fitting connector and configured to attach to a pack at another end opposite the anchoring strip, and a shoulder strap having a channel proximate a shoulder strap connector and configured to retain the anchoring strip when the connection fitting connector is attached to the shoulder strap connector, the shoulder strap being configured to attach to a pack at another end opposite the shoulder strap connector, the shoulder strap having a guideway through the channel configured to receive the chest compression strap loop, wherein the anchoring strip engages the loop when the anchoring strip is retained in the channel.

The channel may extend along the strap and have sides to restrict lateral movement of the anchoring strip with respect to the shoulder strap. The sides may be comprised of transverse stitching with respect to the shoulder strap, the stitching attaching a length of webbing to the shoulder strap, the stitching forming the channel between the webbing and the shoulder strap. The guideway may be laterally across the shoulder strap and into the channel. The loop may be a fold of the chest compression strap attached to the chest compression strap.

A lesser or more equipped shoulder strap, connection fittings, channel, guideway anchoring strip, or pack than the examples described above may be desirable for certain implementations. Therefore, the configuration of the system will vary from implementation to implementation depending upon numerous factors, such as price constraints, performance requirements, technological improvements, and/or other circumstances].

The present description presents the examples using particular terms, such as webbing, strap, quick release, anchoring strip, loop etc. These terms are used to provide consistent, clear examples, however, the present invention is not limited to any particular terminology. Similar ideas, principles, methods, apparatus, and systems can be developed using different terminology in whole, or in part. In addition, the present invention can be applied to ideas, principles, methods, apparatus, and systems that are developed around different usage models and hardware configurations.

In the present description, for the purposes of explanation, numerous specific details are set forth in order to provide a thorough understanding of the present invention. However, the present invention can be practiced without some of these specific details. In other instances, well-known structures and devices are shown in block diagram form. The specific detail can be supplied by one of average skill in the art as appropriate for any particular implementation.

Although this disclosure describes illustrative embodiments of the invention in detail, it is to be understood that the invention is not limited to the precise embodiments described. The specification and drawings are, accordingly, to be regarded in an illustrative rather than a restrictive sense. Various adaptations, modifications and alterations may be practiced within the scope of the invention defined by the appended claims.

What is claimed is:

1. A strap assembly comprising:

at least one shoulder strap having a channel and a shoulder strap connection fitting located at a distal end of the channel;

at least one chest compression strap; and at least one quick release assembly that is secured to the shoulder strap by the shoulder strap connection fitting, the quick release assembly having a quick release connection fitting, an adjustment fitting and an anchoring strip, the quick release connection fitting, the adjustment fitting and the anchoring strip being connected by a folded length of webbing and secured together, the adjustment fitting at a distal end of the quick release assembly having a length of webbing threaded through it that connects to a shoulder-mounted load, the quick release connection fitting at a proximal end of the quick release assembly connecting to the shoulder strap connection fitting so that the anchoring strip extends through the channel and engages the chest compression strap, wherein upon releasing the quick release connection fitting at the distal end of the shoulder strap channel, the quick release assembly moves down and away, pulling the anchoring strip out of the channel and releasing the chest compression strap.

2. The assembly of claim 1, wherein the anchoring strip and the folded length of webbing are secured together by stitching.

3. The assembly of claim 1, wherein the chest compression strap has a loop at one end that is inserted transversely into the channel to engage the anchoring strip.

4. The assembly of claim 3, wherein the channel comprises a second length of webbing stitched along its sides to the shoulder strap.

5. The assembly of claim 4, where the stitching includes gaps along the second length of webbing configured for the loop to be inserted into the channel.

6. A strap assembly comprising:

a chest compression strap assembly;

a connection fitting having an anchoring strip; and a shoulder strap having a guideway configured to receive the chest compression strap assembly inserted therein and a channel to receive the anchoring strip inserted therein to secure the chest compression strap assembly in the guideway, a proximal end of the shoulder strap configured to be worn over a shoulder of a wearer and secured to a shoulder mounted load, the connection fitting further comprising a quick release assembly on a distal end of the connection fitting having a length of webbing threaded through the connection fitting that connects to a pack, the connection fitting further connecting to the shoulder strap channel opposite the distal end.

7. The assembly of claim 6, wherein the chest compression strap assembly includes a second connection fitting with an integrated adjustment feature and a strap secured to the second connection fitting on one end and folded in a configuration of a securement loop on an opposite end, the securement loop being configured to engage the anchoring strip in the guideway.

8. The assembly of claim 7, wherein the strap of the securement loop is fastened in a loop by stitching.

9. The assembly of claim 6, wherein the guideway is positioned across the channel.

10. The assembly of claim 6, wherein the connection fitting comprises a male and a female connector configured to lock together.

11. The strap assembly of claim 6, wherein when the connection fitting at the distal end of the shoulder strap channel is released, then the quick release assembly moves down and away, pulling the anchoring strip out of the channel and releasing the chest compression strap from the guideway disengaging a shoulder mounted load from a wearer.

12. A strap assembly comprising:

a chest compression strap having a loop at one end;

a connection fitting having an anchoring strip and a connection fitting connector at one end and configured to attach to a pack at another end opposite the anchoring strip; and a shoulder strap having a channel and a shoulder strap connector and configured to retain the anchoring strip in the channel when the connection fitting connector is attached to the shoulder strap connector, the shoulder strap being configured to attach to a pack at an end opposite the shoulder strap connector, the shoulder strap having a guideway through the channel configured to receive the chest compression strap loop, wherein the anchoring strip engages the loop when the anchoring strip is retained in the channel.

13. The assembly of claim 12, wherein the channel extends along the shoulder strap and has sides to restrict lateral movement of the anchoring strip with respect to the shoulder strap.

14. The assembly of claim 13, wherein the sides are comprised of transverse stitching with respect to the shoulder strap, the stitching attaching a length of webbing to the shoulder strap, the stitching forming the channel between the webbing and the shoulder strap.

15. The assembly of claim 13, wherein the guideway is laterally across the shoulder strap and into the channel.

16. The assembly of claim 12, wherein the loop is a fold of the chest compression strap attached to the chest compression strap.

17. The assembly of claim 12, wherein the connection fitting further comprises a base plate of a semirigid material that is secured to the anchoring strip and to the connection fitting connector.

18. The assembly of claim 17, wherein the anchoring strip is a semirigid material.

19. The assembly of claim 12, wherein the connection fitting connector is a quick release connector.

20. The assembly of claim 12, further comprising a second shoulder strap and a second connection fitting attached to a pack, wherein the first and second shoulder straps are attached to a top of the pack and the first and second connection fittings are attached to a bottom of the pack, wherein releasing the shoulder strap connectors from the connection fitting connectors releases the anchoring strips from the channels.

* * * * *